US005151624A

United States Patent [19]

Stegherr et al.

[11] Patent Number: 5,151,624

[45] Date of Patent: Sep. 29, 1992

[54] MULTIPLIER CIRCUIT

[75] Inventors: Michael Stegherr, Neubiberg; Bruno Pfäffel, Höhenkirchen-Siegertsbrunn, both of Fed. Rep. of Germany

[73] Assignee: Siemens Aktiengesellschaft, Munich

[21] Appl. No.: 773,556

[22] PCT Filed: May 17, 1990

[86] PCT No.: PCT/DE90/00371

§ 371 Date: Nov. 5, 1991

§ 102(e) Date: Nov. 5, 1991

[87] PCT Pub. No.: WO90/15397

PCT Pub. Date: Dec. 13, 1990

[30] Foreign Application Priority Data

May 31, 1989 [DE] Fed. Rep. of Germany ..... 3917714

[51] Int. Cl.[5] ..... G06G 7/12; G06G 7/00; G06G 7/16

[52] U.S. Cl. ..... 307/498; 307/529; 328/160

[58] Field of Search ..... 307/254, 529, 355, 498, 307/241, 242, 243, 490; 328/158, 160

[56] References Cited

U.S. PATENT DOCUMENTS 4,353,000 10/1982 Noda ..... 307/490
4,870,303 7/1989 McGinn ..... 328/160

FOREIGN PATENT DOCUMENTS

3829164C1 8/1989 Fed. Rep. of Germany .

OTHER PUBLICATIONS

"Analysis and Design of Analog Integrated Circuits" Grey, Meyer, Second Edition, John Wiley & Sons, 1984, pp. 590–605.

"Monolithic Analog Multiplier-Divider", Johan H. Juijsing, et al, IEEE Journal of Solid-State Circuits, vol. Sc-17, No. 1, Feb. 1982, pp. 9–15.

*Primary Examiner*—Stanley D. Miller
*Assistant Examiner*—Sinh Tran
*Attorney, Agent, or Firm*—Hill, Van Santen, Steadman & Simpson

[57] ABSTRACT

The invention relates to a multiplier circuit which is constructed from two multiplier cells according to the prior art. The disadvantage of different signal transit times in the emitter followers and the differential stages for the two input signals to be treated identically is overcome by arranging the transmission paths symmetrically. The limiting frequency of the arrangement according to the invention is no longer limited by the phase error, but solely by the switching time of the bipolar transistors employed, and is therefore higher than in a multiplier circuit according to the prior art. For all frequencies below the limiting frequency, given a phase difference of 90° the output signal lies exactly in the middle of the modulation range.

8 Claims, 3 Drawing Sheets

MULTIPLIER CIRCUIT

BACKGROUND OF THE INVENTION

The invention relates to a multiplier circuit.

Analog multiplier circuits which have two analog inputs, form a product of the two input signals and forward this product to an analog output are frequently required in signal processing. Multiplier circuits—whether employing analog or digital circuitry—are components which are known and frequently used. For instance, an emitter-coupled transistor pair can be cited here as a very simple realisation of an analog multiplier circuit (cf. Gray, Meyer, "Analysis and Design of Analog Integrated Circuits", Second Edition, John Wiley and Sons, 1984, on pages 590 to 593). In FIG. 10.6 of this publication the base terminals and the common emitter terminal, respectively, of the transistor pair form the two analog inputs and the collector terminals form the outputs of an analog multiplier.

Analog multiplier circuits are employed, for instance, as a phase detector or in frequency doubling circuits. As a phase detector, the multiplier circuit is intended to supply an output voltage proportional to the phase difference at the input, and this up to as high a frequency as possible. Given a phase difference of 90° at both inputs, the output voltage of the phase detector should lie in the middle of the modulation range. This corresponds to a phase error of zero. The modulation range of the phase detector should be 180°. In addition to an analog multiplier circuit, a frequency doubler also contains a 90° phase shifter in order to be able to achieve an effective frequency doubling in large-signal operation in the case of sinusoidal input signals with equal phase. It should also be able to supply true push-pull signals up to the highest frequencies.

A Gilbert cell is frequently employed in the present state of the art as a multiplier circuit for phase detection or frequency doubling. The design and the use of such a Gilbert cell can be found in the above-mentioned publication by Gray, Meyer: "Analysis and Design of Analog Integrated Circuits" on pages 593 to 605. In the case of digital input signals, the Gilbert cell here provides an XOR gating as a logic function. The suitability of this circuit in the case of frequencies close to the limiting frequency of the bipolar transistors is lessened by the different transit times in the lower and upper circuit level of the Gilbert cell. Given a different number of additional upstream level-shift stages in the lower and the upper circuit level of the Gilbert cell, besides an additional transit time as a result of the differential stage in the lower circuit level, a further transit time as a result of the different number of level-shift stages is produced as the total transit time difference between the input signals of the upper and lower circuit level. When employed as a phase detector this asymmetry leads to a phase error which rapidly increases as the frequency rises and greatly reduces the symmetry of the output characteristic around the mid-position at 90°. In the case of a frequency doubling circuit the same transit time effect leads to an alteration of the amplitude ratios of the push-pull outputs.

SUMMARY OF THE INVENTION

The object of the invention is to disclose a multiplier circuit which has a symmetrical characteristic given a 90° phase difference of the input signals even for high frequencies when employed as a phase detector, and does not lead to any alteration of the amplitude ratios at the push-pull outputs at high frequencies when employed in a frequency doubling circuit.

The particular advantages conferred by the invention are that the limiting frequency of the multiplier circuit according to the invention is no longer limited by the phase error, but solely by the switching time of the bipolar transistors; it is therefore higher than in conventional multiplier circuits. For all frequencies below the limiting frequency, given a phase difference of 90° the output signal lies exactly in the middle of the modulation range.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

Figure 1:
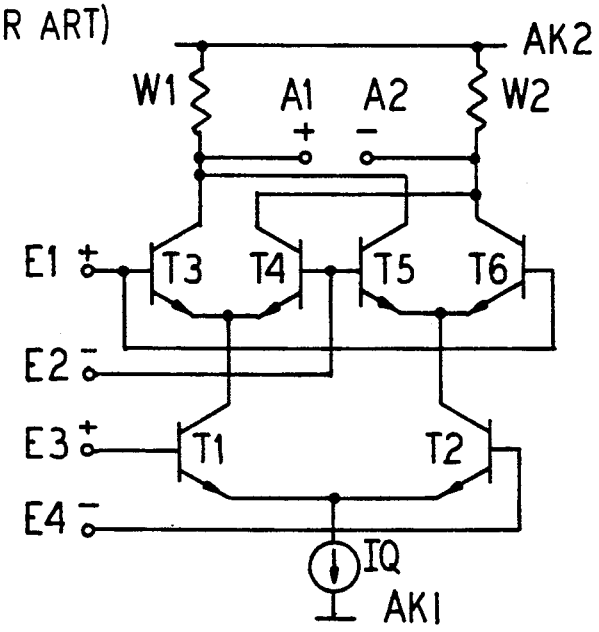
FIG. 1 (PRIOR ART)
FIG. 1 shows a multiplier circuit according to the prior art (Gilbert cell)

FIG. 1 shows an analog multiplier cell according to the prior art, which is likewise also referred to as a Gilbert cell. Its design and its function can be found in the abovementioned publication by Gray, Meyer: "Analysis and Design of Analog Integrated Circuits", FIGS. 10.9, 10.10 and also 10.16 on pages 593 to 605. Depending on the ratio of the threshold voltage of the input transistors to the input signals, three areas can be defined for the practical application of this multiplier cell. In the first application area the input voltage amplitudes are lower compared with the voltage equivalent of thermal energy ($kT/e=26$ mV) of the input transistors, in the second application area the amplitude of one of the input signals is greater in comparison to that of the voltage equivalent of thermal energy of the input transistors, and in the third application area the amplitude of both input signals is higher than that of the voltage equivalent of thermal energy of the input transistors. The last-mentioned application area is particularly suitable for the detection of phase differences between two amplitude-limited input signals, as are frequently required in PLL circuits.

The multiplier cell according to FIG. 1 can be divided into a lower and downstream upper circuit level, a first pair of input terminals E1, E2 being assigned to the upper circuit level and a second pair of input terminals E3 being assigned to the lower circuit level. The multiplier cell is connected between a first voltage terminal AK1, which is connected to a negative pole of the supply voltage, and a second voltage terminal AK2, which is connected to ground. A first and second resistance element W1, W2 is arranged in each case between the second voltage terminal AK2 and the first and second output terminals A1, A2, respectively, of the multiplier cell. The lower circuit level contains a first emitter-coupled transistor pair with a first and second bipolar transistor T1, T2, and the upper circuit level contains two emitter-coupled transistor pairs which have a third, fourth and also fifth and sixth bipolar transistor T3, T4, T5 and T6. A base terminal of the first and a base terminal of the second bipolar transistor T1 and T2 respectively form the two input terminals E3, E4 of the multiplier cell in each case. An emitter terminal of the first and an emitter terminal of the second bipolar transistor are together connected via a current source IQ to the first voltage terminal AK1. A collector terminal of the first bipolar transistor T1 is connected to the emitter terminal of the third bipolar transistor T3 and simultaneously to the emitter terminal of the fourth bipolar transistor T4, while a collector terminal of the second bipolar transistor T2 is connected to an emitter terminal of the fifth bipolar transistor T5 and jointly to an emitter terminal of the sixth bipolar transistor T6. A base terminal of the third and a base terminal of the sixth bipolar transistor T3, T6 together form the first E1 of the two input terminals E1, E2, and a base terminal of the fourth together with a base terminal of the fifth bipolar transistor T4, T5 form the second E2 of the two input terminals E1, E2. The collector terminal of the third and the collector terminal of the fifth bipolar transistor T3, T5 together represent the first Al of the two output terminals A1, A2 and are connected via the first resistance element W1 to the second voltage terminal AK2, while the collector terminal of the fourth and the collector terminal of the sixth bipolar transistor T4, T6 forms the second A2 of the two output terminals A1, A2 and is likewise to be connected to the second voltage terminal AK2 via the second resistance element W2.

In FIG. 1, "+" and "−" signs, which are to be interpreted as voltage signs, are additionally entered at the inputs and outputs of the multiplier cell. If, accordingly, a positive input voltage is applied in each case to E1 in comparison with E2, and to E3 in comparison with E4, the output signal resulting from this at the output A1 will lie in the negative range in comparison with A2.

The Gilbert cell is a modification of an emitter-coupled transistor pair. It permits a four-quadrant multiplication, so that the two input signals can lie both in the positive and in the negative value range. According to FIG. 1, all bipolar transistors employed are npn bipolar transistors. It can be seen from the direct current analyses of the Gilbert cell on pages 493 to 495 of the publication by Gray, Meyer "Analysis and Design of Analog Integrated Circuits" that the voltage at the output terminals of the Gilbert cell is a product of the hyperbolic tangential function of the input signals. It is possible for small input signals here for the hyperbolic tangential function to be substituted by its argument in a first approximation.

As already indicated in the introduction, the suitability of this circuit is lessened at frequencies close to the limiting frequency of the bipolar transistors due to the different transit times in the lower and upper circuit level. When employed as a phase detector this asymmetry leads to a phase error which rapidly increases as the frequency rises and greatly reduces the symmetry of the output characteristic around the midposition at 90°. When employed in a frequency doubling circuit this same transit time effect leads to an alteration of the amplitude ratios of the push-pull outputs.

Figure 2:
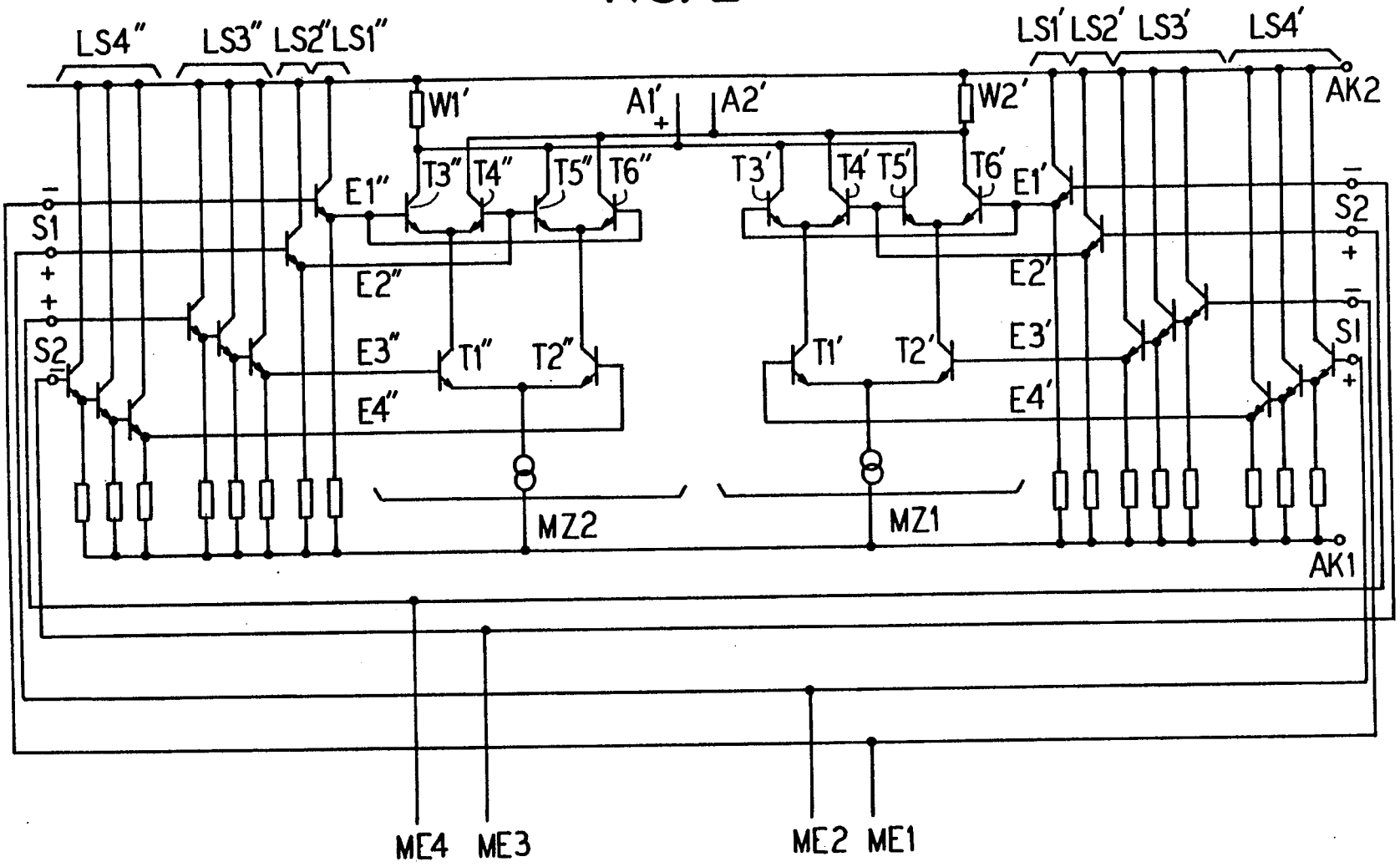
FIG. 2 shows a multiplier circuit according to the invention.

The disadvantage of different signal transit times in the emitter-coupled transistor stages for the two input signals to be treated identically can be remedied by a multiplier circuit according to the invention in accordance with FIG. 2. This disadvantage is overcome here by arranging the transmission paths symmetrically.

In the multiplier circuit according to the invention in accordance with FIG. 2, therefore, each signal S1 and S2 proceeds through both the slower and the faster transmission path and the output signal at the output terminals A1' and A2' is produced as the sum of these two components. As already indicated at the outset, the limiting frequency of this novel arrangement is no longer limited by the phase error, but solely by the switching time of the bipolar transistors, and is therefore higher than in the multiplier circuit according to the prior art from FIG. 1. For all frequencies below this limiting frequency, given a phase difference of the output signals of 90° the output signal lies exactly in the middle of the modulation range.

The multiplier circuit according to the invention contains two multiplier cells, which in detail are to be designed in each case as a Gilbert cell such as in FIG. 1. The outputs of both multiplier cells are connected in parallel and the inputs of the same are connected to the inputs of the multiplier circuit via level-shifter stages LS1', . . . LS4' and LS1" . . . LS4" respectively. An ohmic resistor W1' and W2' connects the outputs A1' and A2' respectively to the second voltage terminal AK2 in each case. Each multiplier cell contains a current source, as well as a lower and downstream upper circuit level. The inputs E3', E4' and E3", E4" are assigned to the lower circuit level with in each case one emitter-coupled transistor pair (T1', T2'/T1", T2") respectively, while in the upper circuit level in each case two emitter-coupled transistor pairs (T3', T4'/T5', T6' and T3", T4"/T5", T6" respectively) are driven via the inputs E1', E2' and E1", E2" respectively. According to FIG. 2, the output A1' of the multiplier circuit is formed by the collector outputs T5' and T3' of the multiplier cell MZ1 together with the collector outputs T5" and T3" of the multiplier cell MZ2. The output A2', on the other hand, is to be constructed from a common connection between the collector outputs of T4', T6' from MZ1 and the collector outputs of T4" and T6" from MZ2. As already indicated, the output A1' is to be connected via the resistance element W1' and the output A2' is to be connected via the resistance element W2' to the second voltage terminal AK2 in each case.

The level shifters at the inputs of the two multiplier cells MZ1, MZ2 can be subdivided into two groups: into a first group which is constructed as a single stage and to which LS1', LS2', LS1" and LS2" belong, and into a second group of three-stage level shifters, to which LS3', LS4', LS3" and LS4" belong. A single stage is constructed in each case from a bipolar npn transistor with a resistance element or a current source. The base terminal serves here as an input for such a level shifter, while the collector terminal is connected to the second voltage terminal AK2, and the emitter terminal is connected to the first voltage terminal AK1 via the resistance element or the current source. The emitter terminal simultaneously also forms the output of a single-stage level shifter. If the level shifter is one with multiple stages, then the individual stages are connected in series and the output of the preceding level-shifter stage is connected to the input of the next level-shifter stage. It can further be seen from FIG. 2 that the three-stage level shifter LS3' is connected to the input E3', the three-stage level shifter LS4' is connected to the input E4', the three-stage level shifter LS3'' is connected to the input E3'', and the likewise three-stage level shifter LS4'' is connected to the input E4''. The single-stage level shifters LS1' and LS2' are to be connected to the input E1' and E2' respectively, and LS1'', LS2'' are to be connected to the input E1'' and E2'' respectively. Finally, the inputs of the multiplier circuit ME1 . . . ME4 are to be connected to the inputs of the two multiplier cells via the associated level shifters as follows. The terminal ME1 is connected on the one hand via the level shifter LS3' to E3' and via the level shifter LS1'' to E1'', and the terminal ME2 is connected via the level shifter LS4' to E4' and via the level shifter LS2'' to E2''. The terminal ME3 is to be connected via the level shifter LS1' to the input E1' and via the level shifter LS4'' to the input E4'', while the terminal ME4 is to be connected via the level shifter LS2' to the input E2' and via the level shifter LS3'' to the input E3'' of the multiplier cell.

As in FIG. 1, in the representation of FIG. 2 "+" and "−" signs are additionally entered at all inputs and outputs of the multiplier cells MZ1 and MZ2 in order to record voltage values with the correct sign. It should be ensured here that the input signal S2 is fed into MZ1 and with reversed polarity into MZ2, while the input signal S1 is supplied to MZ1 and MZ2 with the same polarity.

As in FIG. 1, the second voltage terminal AK2 is to be connected to the reference potential and the first voltage terminal AK1 is to be connected to a negative pole of the supply voltage (−5 volts for instance). As in FIG. 1, all bipolar transistors employed are likewise designed as npn bipolar transistors.

Figure 3:
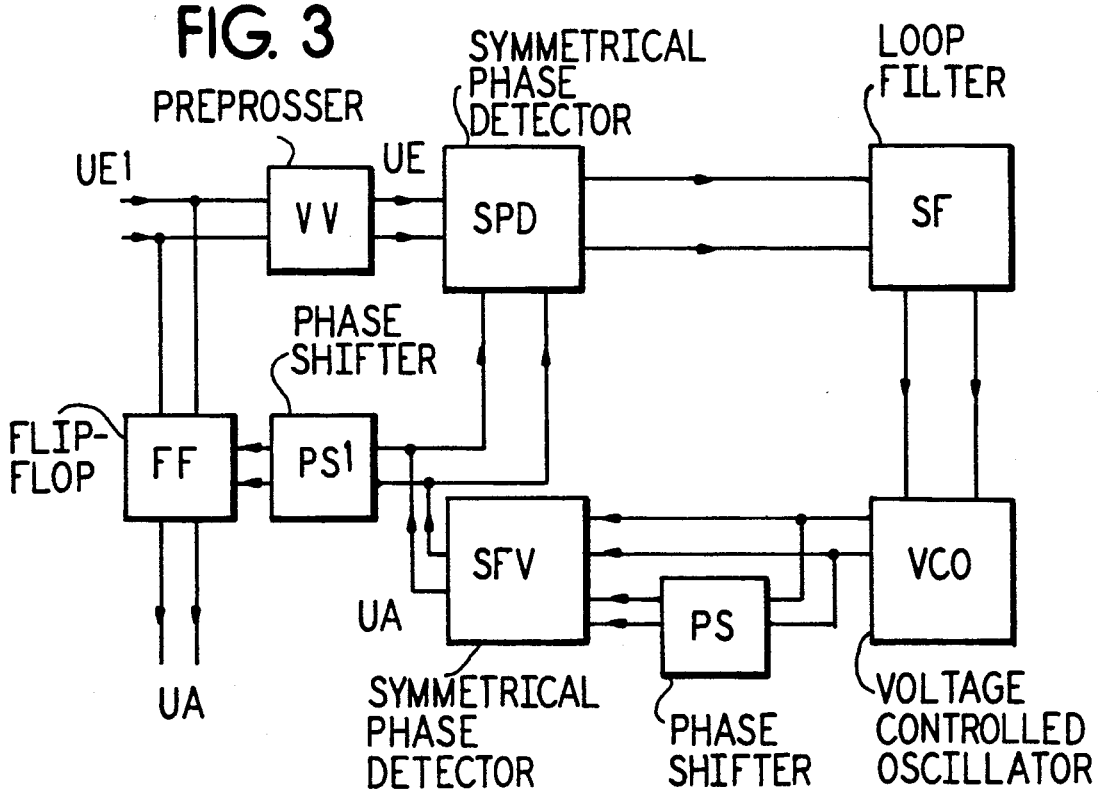
FIG. 3 shows an example of using the multiplier circuit according to the invention in a PLL circuit.

FIG. 3 shows a circuit for timing recovery with the aid of a phase-locked loop PLL in which the multiplier circuit according to the invention can be advantageously incorporated. A phase-locked loop represents a particularly important control technology application in telecommunications. The PLL circuit ensures that an output signal UA is set in such a way that it matches an input signal UE with respect to frequency, namely so precisely that a phase shift between the two signals remains constant. In the circuit for timing recovery according to FIG. 3, the PLL circuit here has the task of recovering a stable clock signal UA from the data stream in order to clock the decision flip-flop FF. In the case of NRZ signals (non return to zero) a preprocessing stage VV is to be added here, which generates a line for the clock frequency from the input spectrum. The phase position of the clock signal relative to the input data stream UE' is set by an adjustable phase shifter PS'. The input stream UE' is therefore applied both to the input of the decision flip-flop FF and directly via the preprocessing stage VV as input signal UE to the PLL circuit, and the clock input of the decision flip-flop FF is connected via the adjustable phase shifter PS, to the output signal UA of the PLL circuit. The regenerated data stream UA' can then be taken as an output signal from the decision flip-flop FF. The decision flip-flop FF functions as a sample-and-hold circuit and stores for an entire clock cycle the signal value applied at the time of sampling. The PLL circuit PLL itself contains a symmetrical phase detector SPD, a loop filter SF, a voltage-controlled frequency oscillator VCO, a phase shifter PS and also a symmetrical frequency doubler SFV. The symmetrical phase detector SPD forms from the input signal UE and the output signal of the symmetrical frequency doubler SFV a system deviation signal which is applied via a loop filter SF to the voltage-controlled frequency oscillator VCO. The loop filter SF functions as a low-pass filter, damps the higher-frequency signal component of the system deviation signal and forms a direct-current voltage signal for controlling the voltage-controlled frequency oscillator VCO. For this purpose, the output of the symmetrical frequency doubler SFV is applied to the first input of the symmetrical phase detector SPD and the input signal UE is applied to the second input of the same, and the output of the symmetrical phase detector is connected via the loop filter SF to the voltage-controlled frequency oscillator VCO. Finally, the output of the voltage-controlled frequency oscillator VCO is connected on the one hand directly and on the other hand via a phase shifter PS to the symmetrical frequency doubling circuit SFV. The phase shifter PS is necessary here for frequency doubling since in large-signal operation the symmetrical frequency doubling circuit SFV requires two input signals with a mutual offset of 90°.

In an integrated PLL circuit the voltage-controlled oscillator is usually the element that limits the working frequency of the entire loop. If the voltage-controlled oscillator is employed in the PLL circuit together with a symmetrical frequency doubler realized by the multiplier circuit according to the invention, this speed limitation can be overcome. The gain in speed attainable can then be used for the whole loop if, in contrast to the standard circuit, the symmetrical phase detector is likewise constructed with the aid of the multiplier circuit according to the invention and thus satisfies this speed requirement.

Furthermore, the usable frequency range of a frequency doubling circuit, as is also used in the pre-processing stage VV of a PLL circuit necessary for NRZ signals, which is constructed with the symmetrical multiplier circuit according to the invention can also be increased in comparison with standard circuits.

If the symmetrical phase detector is constructed with the aid of the multiplier cell according to the invention, then it is no longer necessary to compensate the frequency-dependent phase error of a simple multiplier detector according to the prior art. It is only necessary to compensate the transit time of the preprocessing stage VV by the phase shifter PS'.

Figure 4:
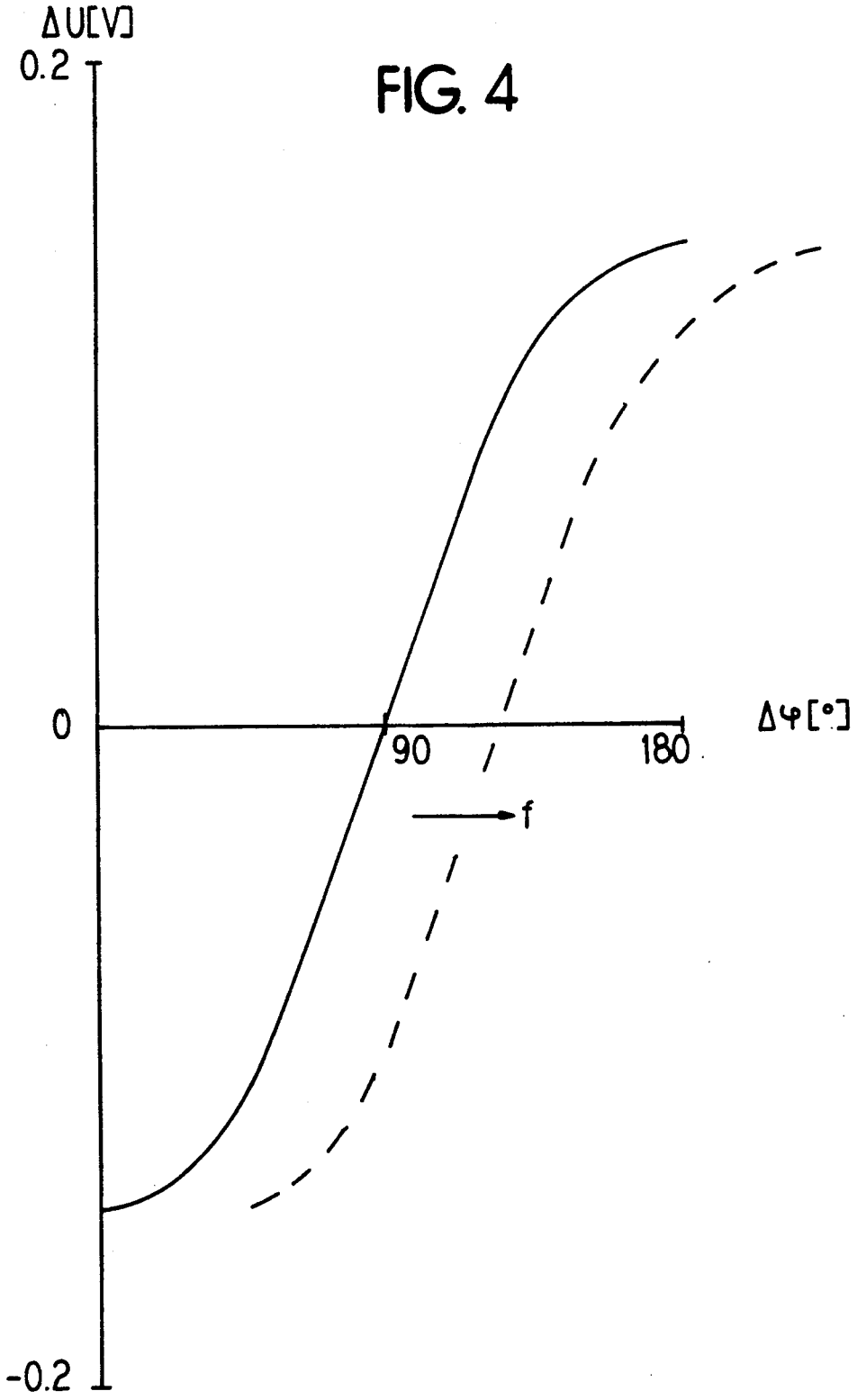
FIG. 4 shows the detector characteristic of the PLL circuit according to FIG. 3.

FIG. 4 shows the detector characteristic, in accordance with which the two input signals for the synchronous phase detector (in this case UA and UE) are adjusted to a fixed phase distance of 90°. A PLL circuit acts here like a feedback control circuit and has the effect that the system deviation signal $\Delta U$ is always minimized. If standard components were to be employed in the PLL circuit of FIG. 3 in the synchronous phase detector SPD and the synchronous frequency doubler SFV instead of the multiplier circuit according to the invention, the sinusoidal detector characteristic would shift to the right for rising frequencies and thus produce a phase error in the phase relation of the two signals UA, UE (indicated by the arrow direction for high frequencies in FIG. 4). This would have to be compensated, as already mentioned, by an adjustable phase shifter PS'.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A multiplier circuit having a first pair and a second pair of input terminals and first and second output terminals comprising: at least first and second multiplier cells; the second multiplier cell having a lower circuit level and a downstream upper circuit level, a first pair of input terminals of the second multiplier cell assigned to the upper circuit level thereof and connected to the first pair of input terminals of the multiplier circuit, and a second pair of input terminals assigned to the lower circuit level thereof and connected to the second pair of input terminals of the multiplier circuit, the second multiplier cell connected to a first voltage terminal, the first output terminal of the multiplier circuit connected via a first resistance element to a second voltage terminal, and the second output terminal of the multiplier circuit connected to the second voltage terminal via a second resistance element, the first multiplier cell having a lower circuit level and a downstream upper circuit level, a first pair of input terminals of the first multiplier cell assigned to the upper circuit level thereof and connected to the second pair of input terminals of the second multiplier cell, and a second pair of input terminals of the first multiplier cell, assigned to the lower circuit level thereof and connected to the first pair of input terminals of the second multiplier cell, the first multiplier cell connected to the first voltage terminal, and a first output terminal of the second multiplier cell and a first output terminal of the first multiplier cell connected together and forming the first output terminal of the multiplier circuit, and a second output terminal of the second multiplier cell and a second output terminal of the first multiplier cell connected together and forming the second output terminal of the multiplier circuit.

2. The multiplier circuit according to claim 1, wherein the second multiplier cell and the first multiplier cell are constructed identically and wherein each of the first and second multiplier cells has in the lower circuit level an emitter-coupled transistor pair with first and second bipolar transistors and in the upper circuit level two emitter-coupled transistors pairs with third, fourth and fifth and sixth bipolar transistors, wherein a base terminal of the first bipolar transistor and a base terminal of the second bipolar transistor form the second pair of input terminals of the respective multiplier cell, wherein an emitter terminal of the first bipolar transistor and an emitter terminal of the second bipolar transistor are connected via a current source to the first voltage terminal, wherein a collector terminal of the first bipolar transistor is connected to the emitter terminal of the third bipolar transistor and to the emitter terminal of the fourth bipolar transistor, and a collector terminal of the second bipolar transistor is connected to an emitter terminal of the fifth bipolar transistor and to an emitter terminal of the sixth bipolar transistor, wherein a gate terminal of the third bipolar transistor together with a gate terminal of the sixth bipolar transistor and a gate terminal of the fourth bipolar transistor together with a gate terminal of the fifth bipolar transistor form the first pair of input terminals of the respective multiplier cell, and wherein a collector terminal of the third bipolar transistor together with a collector terminal of the fifth bipolar transistor and a collector terminal of the fourth bipolar transistor together with a collector terminal of the sixth bipolar transistor form the first and second output terminals of the respective multiplier cell.

3. The multiplier circuit according to claim 2, wherein for each multiplier cell, the second pair of input terminals has a first input terminal connected to the base terminal of the first bipolar transistor of the respective multiplier cell, and a second input terminal connected to the base terminal of the second bipolar transistor of the respective multiplier cell and the first pair of input terminals of the respective multiplier cell has a first input terminal connected to the base terminal of the third and sixth bipolar transistors of the respective multiplier cell, and a second input terminal connected to the base terminal of the fourth and fifth bipolar transistors of the respective multiplier cell, and wherein the first input terminal and the second input terminal of the second pair of input terminals of the first multiplier cell are connected, respectively, to the first input terminal and the second input terminal of the first pair of input terminals of the second multiplier cell, and the first input terminal and the second input terminal of the first pair of input terminals of the first multiplier cell are connected, respectively, to the second input terminal and the first input terminal of the second pair of input terminals of the second multiplier cell.

4. The multiplier circuit according to claim 1, wherein level-shift stages of a first type are connected between the first pair of input terminals of the second multiplier cell and the first pair of input terminals of the multiplier circuit, and also between the first pair of input terminals of the first multiplier cell and the second pair of input terminals of the multiplier circuit, and wherein level-shift stages of a second type are connected between the second pair of input terminals of the second multiplier cell and the second pair of input terminals of the multiplier circuit, and also between the second pair of input terminals of the first multiplier cell and the first pair of input terminals of the multiplier circuit.

5. The multiplier circuit according to claim 4, wherein each level-shift stage of the second type contains three series-connected level-shift stages of the first type.

6. The multiplier circuit according to claim 4, wherein each of the level-shift stages of the first type contains a further bipolar transistor and a resistance element, wherein a base terminal of the further bipolar transistor is an input of the respective level-shift stage of the first type and an emitter terminal of the further bipolar transistor is an output of the respective level-shift stage of the first type, wherein the emitter terminal of the further bipolar transistor is connected via the resistance element to the first voltage terminal and a collector terminal of the further bipolar transistor is connected to the second voltage terminal.

7. The multiplier circuit according to claim 2, wherein the bipolar transistors are npn transistors, and the first voltage terminal is connected to a negative pole of a voltage source and the second voltage terminal is connected to a reference potential of the voltage source.

8. The multiplier circuit according to claim 6, wherein the bipolar transistors are npn transistors, and the first voltage terminal is connected to a negative pole of a voltage source and the second voltage terminal is connected to a reference potential of the voltage source.

* * * * *